US005961082A

United States Patent [19]

Walter

[11] Patent Number: 5,961,082

[45] Date of Patent: Oct. 5, 1999

[54] SUPPORTING-BAR ARRANGEMENT FOR HANGING GOODS TO BE DISPLAYED OR FOR SUPPORTING A GOODS DISPLAY UNIT

[75] Inventor: Herbert Walter, Müllheim, Germany

[73] Assignee: Fehlbaum & Co., Muttenz, Switzerland

[21] Appl. No.: 08/849,359

[22] PCT Filed: Dec. 7, 1995

[86] PCT No.: PCT/CH95/00293

§ 371 Date: Jun. 6, 1997

§ 102(e) Date: Jun. 6, 1997

[87] PCT Pub. No.: WO96/18329

PCT Pub. Date: Jun. 20, 1996

[30] Foreign Application Priority Data

| | | | |
|---|---|---|---|
| Dec. 13, 1994 | [CH] | Switzerland | 3771/94 |
| Dec. 22, 1994 | [CH] | Switzerland | 3892/94 |
| Jul. 3, 1995 | [EP] | European Pat. Off. | 95810437 |

[51] Int. Cl.[6] ..... F16B 45/00

[52] U.S. Cl. ..... 248/220.21; 248/222.51; 211/87.01; 211/90.01; 40/642.01; 40/606; 52/36.4

[58] Field of Search ..... 248/220.21, 220.22, 248/222.51, 223.41, 224.51, 224.61, 224.7, 224.8, 222.41, 223.21, 225.11, 235; 211/87.01, 90.01, 90.02, 90.04; 52/36.4, 27, 698, 711, 699; 40/642.01, 605, 606

[56] References Cited

U.S. PATENT DOCUMENTS

| | | | |
|---|---|---|---|
| 459,844 | 9/1891 | Thomas | 248/222.51 X |
| 1,090,486 | 3/1914 | Lohmann | 52/711 |
| 1,800,386 | 4/1931 | Hoffman | 248/307 |
| 1,800,387 | 4/1931 | Greist | 248/307 |
| 2,614,701 | 10/1952 | Mapson . | |
| 2,965,235 | 12/1960 | Daline | 211/87.01 X |
| 3,296,725 | 1/1967 | Fenwick | 40/606 X |
| 3,704,675 | 12/1972 | Bellasalma | 248/220.22 X |
| 3,707,049 | 12/1972 | Thalenfeld | 40/642.01 |
| 4,308,961 | 1/1982 | Kunce | 248/222.51 X |
| 4,316,547 | 2/1982 | Varon . | |
| 4,982,922 | 1/1991 | Krause | 248/222.51 |
| 5,109,992 | 5/1992 | Miller . | |
| 5,236,344 | 8/1993 | Baron | 248/222.51 |
| 5,372,344 | 12/1994 | Syvuk | 248/222.51 X |
| 5,379,976 | 1/1995 | DeGirolamo | 248/222.51 X |

FOREIGN PATENT DOCUMENTS

| | | |
|---|---|---|
| 0519349 | 12/1992 | European Pat. Off. . |
| 1293293 | 10/1962 | France . |
| 3803829 | 8/1989 | Germany . |
| 778628 | 7/1957 | United Kingdom . |
| 9114388 | 10/1991 | WIPO . |

*Primary Examiner*—Ramon O. Ramirez
*Assistant Examiner*—Stephen S. Wentsler
*Attorney, Agent, or Firm*—Selitto & Associates

[57] ABSTRACT

A goods support bar assembly includes a socket and a support bar that can be easily inserted and removed from the socket. The socket includes a housing with a window-like insertion opening and internally located buffer edges. The support bar includes a slip-in plate which is attached to a tubular piece. By tilting the slip-in plate relative to the socket, the slip-in plate can be inserted through the insertion opening and into the housing, where the buffer edges hold the support bar in position.

16 Claims, 5 Drawing Sheets

SUPPORTING-BAR ARRANGEMENT FOR HANGING GOODS TO BE DISPLAYED OR FOR SUPPORTING A GOODS DISPLAY UNIT

FIELD OF THE INVENTION

The invention relates to a supporting-bar arrangement having a socket provided on a rear wall or on a shelf component and a support bar which can be inserted therein either for hanging goods to be displayed or for fastening a goods display unit.

BACKGROUND OF THE INVENTION

Tables, display cases, stands or shelves configured in a variety of ways are available for the display of goods in retail facilities or at trade fairs. A further possibility is to display the goods to be presented in front of a rear wall or on a column. Support bars which are fastened to the rear wall are used for this purpose. The goods to be shown, for example items of clothing suspended on clothes-hangers, can now be hung directly on the support bar, or goods display units in the form of shelves, bowls or open boxes can be attached to one or more support bars.

U.S. Pat. No. 4,316,547, for example, discloses such a support-bar construction. Running on a rear wall are two vertical rails at a distance from one another and having a hole pattern, where one short rail piece each can be inserted into each rail into two holes at the same level. The two rail pieces project from the rear wall perpendicularly into the room, and a cross bar is placed over the rail pieces. Clothes-hangers are hung directly on the cross bar, and support bars projecting further into the room are mounted directly on the cross bar, which support bars in turn have items of clothing hung on them. Although the support-bar construction is vertically adjustable, it is otherwise less variable due to the requisite hole-pattern rails and in addition is relatively expensive.

SUMMARY OF THE INVENTION

It may be stated in summary that the hitherto known supporting-bar arrangements fulfill the practical requirements only incompletely. The object of the invention is therefore to propose an improved supporting-bar arrangement which is simple to mount on a rear wall, a panel or a shelf component, the design of which is not complicated, and which can be changed in no time but nonetheless sits securely in the socket and appears exactly oriented without great effort in a row arrangement with a plurality of support bars. In addition, it is to be possible to combine a plurality of support bars or to provide them with goods display units, such as shelves or open boxes. The support bar must also be locked in the socket in a stable manner without additional safety measures if the support bar tilts downwards in a projecting manner into the room. Unoccupied sockets must not have an adverse effect on the aesthetic appearance of the rear wall.

BRIEF DESCRIPTION OF THE DRAWINGS

Furthermore, the invention, in the various possible embodiment variants, is explained in detail with reference to the attached diagrammatic sketches, in which:

FIG. 1.1 shows a sectional representation of the socket with juxtaposed support bar according to FIG. 1.0;

FIG. 1.2 shows a sectional representation of the socket according to FIG. 1.0 with frame;

FIG. 1.3 shows the socket according to FIG. 1.0 screwed to a rear wall and with inserted support bar (direct mounting on a wall);

FIG. 1.4 shows the socket according to FIG. 1.0 inserted into a panel in front of a rear wall (mounting inside a wall facing);

FIG. 2.1 shows the rear view of the socket according to FIG. 2.0;

FIG. 2.2 shows a perspective view of the socket according to FIG. 2.0 with juxtaposed support bar and frame;

FIG. 2.3 shows the socket according to FIG. 2.0 screwed to a rear wall and with inserted support bar (direct mounting on a wall);

FIG. 2.4 shows the socket according to FIG. 2.0 inserted into a panel with counter-plate (mounting inside a wall facing);

DETAILED DESCRIPTION OF THE DRAWINGS

Figure 1A:
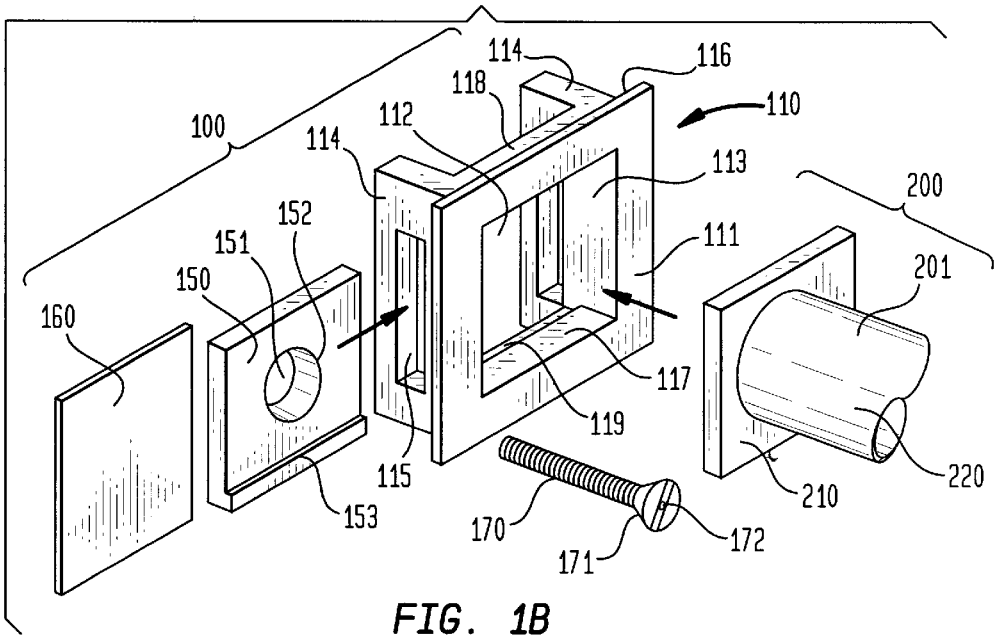
FIG. 1.0 shows a perspective view of the socket with push-in screw-on plate and juxtaposed support bar.
Figure 1B:
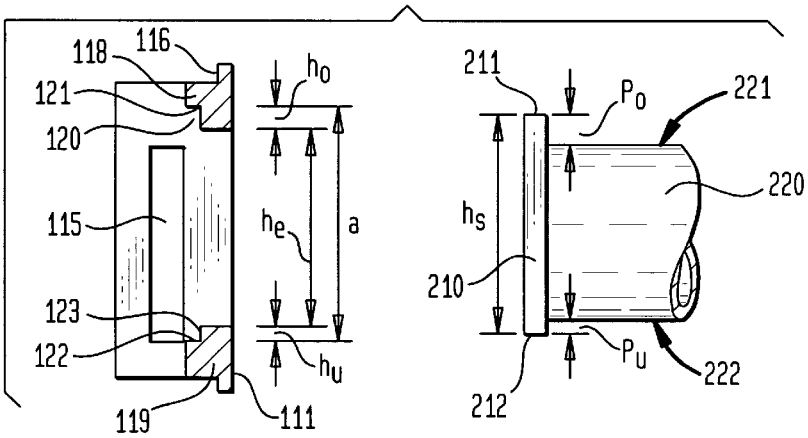
Figure 1C:
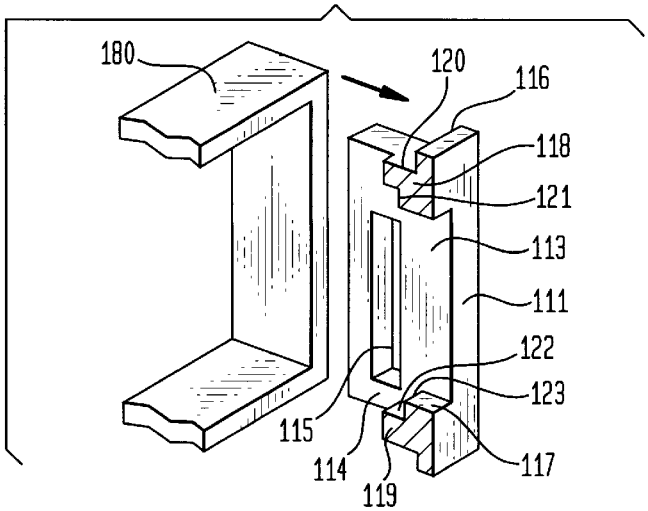
Figure 1D:
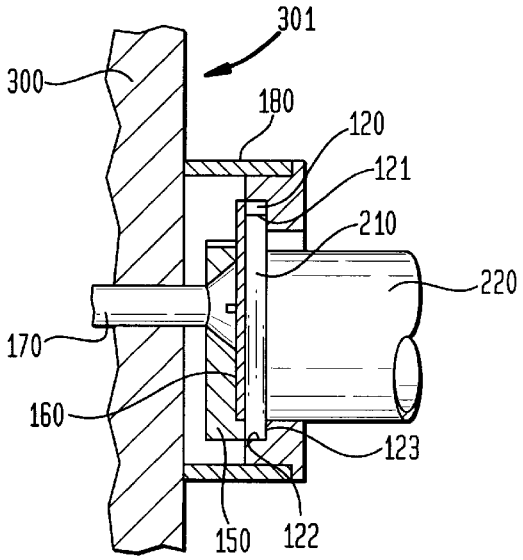
Figure 1E:
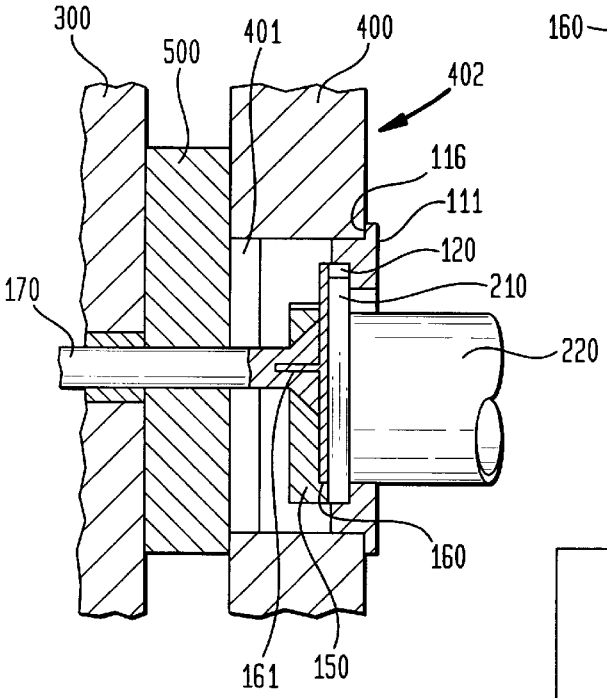

According to FIGS. 1.0 to 1.2, the supporting-bar arrangement, in a first embodiment with push-in screw-on plate 150, consists of the socket 100 and the support bar 200. The socket 100 includes the housing 110, the screw-on plate 150 which can be pushed into the latter, the cover plate 160, the screw 170 and the frame 180.

On its front side, the basically rectangular housing 110 has a mounting flange 111 with a rectangular, window-like insertion opening 112. In a plane with the lateral inner edges 113 of the insertion opening 112, one wall web 114 each extends perpendicularly from the rear side of the mounting flange 111. A slot-shaped aperture 115 is provided in each wall web 114, both apertures 115 being in alignment with one another. The wall webs 114 extend in height and width only so far that an encircling stop edge 116 remains on the rear side of the mounting flange 111. In a plane with the horizontal inner edges 117 of the insertion opening 112, a top and a bottom transverse web 118, 119 run at the top and bottom side of the insertion opening 112 and virtually between the two wall webs 114 spaced apart parallel to one another.

The bottom edge lying in the interior of the housing 110 is recessed out of the top transverse web 118 so that a top undercut 120 having a top buffer edge 121 and the top undercut dimension $h_O$ is obtained. In the same way, the top edge lying in the interior of the housing 110 is recessed out of the bottom transverse web 119 so that a bottom undercut 122 having the bottom buffer edge 123 and the bottom undercut dimension $h_U$ is obtained. The top undercut 120 is deeper in the vertical direction than the lower undercut 122, as a result of which a widened top buffer edge 121 in relation to the bottom buffer edge 123 is obtained; therefore $h_O > h_U$. Both buffer edges 121, 123 lie in a vertical plane.

The screw-on plate 150 is of rectangular contour and can be pushed into the housing 110 through either of the apertures 115. In the fully pushed-in state, the screw-on plate 150 is in the apertures 115 of both wall webs 114 and bridges the intermediate space, the screw-on plate 150 being dimensioned in such a way that it cannot project from the wall webs 114 in this case. The screw-on plate 150 has a concentric through-hole 151 having a countersink 152 in the direction of the insertion opening 112 for accommodating the head 171 of the screw 170. At the bottom edge, the screw-on plate 150 has a mounting edge 153 projecting like a ledge.

The cover plate 160 corresponds at least to the width of the insertion opening 112, whereas its height is dimensioned in such a way that the cover plate 160 extends from the mounting edge 153 up to the top transverse web 118 in order thus to cover the interior of the housing 110 for the view from outside if no support bar 200 is inserted. At the same time, the cover plate 160 acts as a damping intermediate layer between the housing 110 and the slip-in plate 210 provided on the slip-in end 201 of the support bar 200. A slip-in lug 161 (see FIG. 1.4) in a complementary position and of complementary contour in relation to the blind hole 172 located in the head 171 of the screw 170 is arranged on the cover plate 160.

The slip-in plate 210 firmly attached to the slip-in end 201 of the support bar 200 is of rectangular contour, which slip-in plate 210 is joined to the tubular piece 220, for example by welding. The tubular piece 220 may lead out perpendicularly to the slip-in plate 210 if the support bar 200 is to extend horizontally into the room. An oblique extension of the tubular piece 220 on the slip-in plate 210 will be provided if it is desired that the support bar 200 extend into the room in a tilted or upwardly pointing manner. The width of the slip-in plate 210 corresponds to the width of the insertion opening 112 in the housing 110. The height $h_S$ of the slip-in plate 210 must in any case project beyond the height $h_E$ of the insertion opening 112; on the other hand, the slip-in plate 210 does not take up the entire height between the top and bottom undercut 120, 122—the undercut distance a. The remaining vertical clearance between the slip-in plate height $h_S$ and the undercut distance a enables the support bar 200 to be inserted into the socket 100. Thus a $>h_S>h_E$.

The tubular piece 220 is joined to the slip-in plate 210 in a vertically offset manner so that the vertical distance between the slip-in plate top edge 211 and the tubular-piece top edge 221—the plate top dimension $p_O$—is greater than the distance between the slip-in plate bottom edge 212 and the tubular-piece bottom edge 222—the plate bottom dimension $p_U$ (i.e. $p_O>p_U$). The size ratio of plate top dimension $p_O$ and plate bottom dimension $p_U$ is adapted to the size ratio of top undercut dimension ho and bottom undercut dimension $h_U$.

According to FIG. 1.2, a frame 180 which can be slipped onto the housing 110 may be provided. The frame 180 is pushed against the stop edge 116 encircling the mounting flange 111 on the outside, so as to enclose the top and bottom transverse webs 118,119 as well as both lateral wall webs 114. The frame 180 preferably has a material thickness which corresponds to the height of the stop edge 116 so that, when the frame 180 is slipped on, the peripheral surfaces of the housing 110 are in a plane, that is, they have no steps. The width of the frame 180 corresponds to the width of the wall webs 114, as a result of which the frame 180 terminates at the rear side of the housing 110.

Two types of mounting of the socket 100 are apparent from FIGS. 1.3 and 1.4, FIG. 1.3 showing the surface mounting on a wall 300. Located in the housing 110 is the screw-on plate 150, which is fixed with a screw 170 screwed into the wall 300 and, sitting in the two apertures 115, presses the housing in this way onto the wall surface 301. The frame 180 has been slipped on before mounting. After the screw 170 is screwed in, the cover plate 160 is inserted, which is preferably effected through the insertion opening 112. The cover plate 160 sits on the mounting edge 153 of the screw-on plate 150. To fasten the cover plate 160, a slip-in lug 161 could be provided on its rear side, which slip-in lug 161 latches into the blind hole 172 in the he ad 171 of the screw 170 (see FIG. 1.4). The slip-in plate 210 sits in the disc-shaped hollow space between the top and bottom undercuts 120, 122, which slip-in plate 210 is retained to the front by the buffer edges 121 and 123. The tubular piece 220 extends from the slip-in plate 210 into the room.

The support bar 200, i.e. the slip-in plate 210 to be precise, is inserted into the socket 100 in the following manner. First the slip-in plate 210 is passed through the insertion opening 112; in the process, the support bar 200 is lifted at the bar end 202 (see FIG. 5), i.e. the slip-in plate 210 is at an angle. Therefore the plate top dimension $p_O$ can be pushed entirely or for the most part into the top undercut 120. The slip-in plate 210 is then positioned vertically by lowering the tubular piece 220, whereby the plate bottom dimension $p_U$ can be pushed entirely or for the most part into the bottom undercut 122. Although the entire support bar 200, including the slip-in plate 210, sinks slightly, a proportion of the plate top dimension $p_O$ nonetheless strikes the top buffer edge 121 so that the support bar 200 is locked in the socket 100.

The removal of the support bar 200 from the socket takes place in a similar manner in reverse sequence. First the support bar 200 with the slip-in plate 210 must be pushed upwards so that the plate bottom dimension $p_U$ can be unlatched from the bottom undercut 122. By lifting the bar end 202, it then becomes possible to lift the plate top dimension $p_U$ out of the insertion opening 112 and at the same time unlatch the plate top dimension $p_O$ from the top undercut 120 so that the support bar 200 can be removed as a unit.

FIG. 1.4 illustrates the insertion of the socket; here into a panel 400 mounted in front of the wall 300, a distance piece 500 being inserted in between wall 300 and panel 400. The function of the stop edge 116 is effective in this type of mounting. The housing 110 is inserted together with pushed-in screw-on plate 150 into a prepared panel cutout 401 and is screwed to the wall 300 through the distance piece 500 by means of the screw 170. The cover plate 160 is then inserted from the front through the insertion opening 112. The screw 170 pulls the socket 100 in the direction of the wall 300, the stop edge 116 pressing against the panel surface 402 and limiting the pulling-in of the socket 100 into the panel cutout 401. The frame 180 logically is not used here.

The frame 180 would not be required on the whole if the mounting flange 111 had no stop edge 116. This stop edge 116 is also superfluous for the surface mounting on a wall 300 (cf. FIG. 1.3). The stop edge 116 only performs its function in the case of the inserted type of mounting (cf. FIG. 1.4). So that two types of housing 110—with or without stop edge 116—do not need to be manufactured, the stop edge 116 not required in the case of the surface type of mounting is made level with the frame 180.

A second embodiment of the supporting-bar arrangement, namely having fixed screw-on plate 150' and a counter-plate 700', is shown in FIGS. 2.0 to 2.4, this supporting-bar arrangement likewise consisting of a socket 100' and a support bar 200. The constructional design of the support bar 200 has remained unchanged relative to FIGS. 1.0 to 1.4 so that reference is made in this respect to the preceding explanation. The design of the socket 100' having the housing 110' has changed in detail, which housing 110' has a housing base 125' in which the fixed screw-on plate 150' is integrated. The cover plate 160' as well as the frame 180' are also modified. Furthermore, a screw 170 is required for direct mounting on a wall (see FIG. 2.3), whereas an additional counter-plate 700' is provided for mounting on a wall facing (see FIG. 2.4).

The basically rectangular housing 110' has on its front side a mounting flange 111' with a rectangular, window-like insertion opening 112' and on its rear side the housing base 125'. In a plane with the lateral inner edges 113' of the insertion opening 112', one wall web 114' each extends perpendicularly from the rear side of the mounting flange 111' to the housing base 125'. The wall webs 114' extend in height and width only so far that an encircling stop edge 116' remains on the rear side of the mounting flange 111'. In a plane with the horizontal inner edges 117' of the insertion opening 112', a top and a bottom transverse web 118', 119' run at the top and bottom sides of the insertion opening 112' and virtually between the two wall webs 114' spaced apart parallel to one another. The transverse webs 118', 119' likewise occupy the space between the mounting flange 111' and the housing base.

The bottom edge lying in the interior of the housing 110' is recessed out of the top transverse web 118' up to the plane of the screw-on plate 150' so that a top undercut 120' having a top buffer edge 121' and the top undercut dimension $h_O'$ is obtained. The top edge lying in the interior of the housing 110' is recessed out of the bottom transverse web 119' so that a bottom undercut 122' having the bottom buffer edge 123' and the bottom undercut dimension $h_U'$ is obtained. The top undercut 120' is deeper in the vertical direction than the lower undercut 122', as a result of which a widened top buffer edge 121' in relation to the bottom buffer edge 123' is obtained; therefore $h_O'>h_U'$. However, the bottom undercut 122' does not run up to the plane of the housing base 125' or the screw-on plate 150'; on the contrary, a horizontally running, raised stop edge 124' facing the insertion opening 112' and lying above the level of the bottom inner edge 117' is provided on the underside of the screw-on plate 150'. Furthermore, the undercuts 120' and 122' are of different depth in the direction of the front of the mounting flange 111'. Therefore the top horizontal inner edge 117' is wider than the bottom horizontal inner edge 117' or, put another way, the top and bottom buffer edges 121', 123' do not lie in a vertical plane, but the top buffer edge 121' is set back relative to the bottom buffer edge 123' in relation to the housing base 125' or the screw-on plate 150'.

As apparent from FIGS. 2.0 and 2.1, the counter-plate 700' protrudes in terms of its areal extent beyond the housing 110' on all sides. The rectangular counter-plate 700' has a center through-hole 701' approximately at its center as well as four through-holes 702' allocated to the corner regions of the counter-plate 700'. The center hole 701' is complementary to the through-hole 151' located in the screw-on plate 150' in order to afford if necessary passage to a screw 170 if it is intended to screw the housing 110' to a wall 300 in a surface-mounted position (see FIG. 2.3). To accommodate the screw head 171, the screw-on plate 150' has, on the front side 154', a countersink 152' surrounding the through-hole 151'. There are blind tapped holes 126' complementary to the holes 702' provided in the counter-plate 700', which tapped holes 126 extend from the corner regions on the outside 127' of the housing base 125' into the two vertical wall webs 114' arranged frame-like relative to one another and into the transverse webs 118', 119' connecting the latter and are directed perpendicularly to the mounting flange 111'. In this way, the counter-plate 700' can be screwed by means of four screws 703' to the outside 127' of the housing base 125' and thus the entire socket 100' can be fixed in an inserted position in a panel 400 (see FIG. 2.4).

Casting passages 128' which are advantageous from the manufacturing point of view but are functionally unimportant extend from the outside 127' of the housing base 125' into the housing 110'.

One frame groove 129' each likewise runs from the outside 127' of the housing base 125' at the outer flanks of the two wall webs 114' towards the mounting flange 111'. The guide lugs 181' provided inside the frame 180' engage in a positive-locking manner in the two frame grooves 129' when the frame 180' is slipped on. Two vertical grooves 130' at a distance from one another and running up to the top transverse web 118' are located on the rear side of the mounting flange 111' at its top edge, into which vertical grooves 130' the slip-in lugs 191' of an information plate 190' which can be put onto the socket 100' can be inserted (see FIG. 4).

Four through-slots 155' arranged in the corner regions of the screw-on plate 150' extend through the latter from its front side 154'. The hook lugs 161' of the inserted cover plate 160' catch in these through-slots 155'. The hook lugs 161' are provided in the corner regions of the cover plate 160' on its side facing the screw-on plate 150'. The function of the cover plate 160' is to conceal the front side 154', visible from outside, of the screw-on plate 150', in particular in the assembled state of the housing 110', if no support bar 200 is inserted therein. The cover plate 160' could advantageously be made as a one-piece injection moulding.

FIG. 2.3 shows the entire supporting-bar arrangement screwed to a wall 300. In this respect, the mounting principle conforms to the statements made with regard to FIG. 1.3. The housing 110' together with slipped-on frame 180' is screwed to the wall surface 301 by means of the screw 170. The front side 154' of the screw-on plate 150' is provided with the cover plate 160', the hook lugs 161' of the latter engaging in the through-slots 155' in the screw-on plate 150'.

The slip-in plate 210 of the support bar 200 is engaged in the housing 110', sits in the undercuts 120', 122' and in the process strikes the top and bottom buffer edges 121', 123'. The projecting stop edge 124' and the horizontal offset between the top and bottom buffer edges 121', 123' cause the slip-in plate 210 to be set at a slight angle and thus cause the tubular piece 220 starting at the slip-in plate 210 to tilt slightly upwards into the room. This slight tilting of the tubular piece 220 has a pleasing visual effect and therefore a downward deflection of the tubular piece 220 is compensated for even under greater loading, so that, for example, suspended clothes-hangers do not develop the tendency to slip downwards.

FIG. 2.4 shows the supporting-bar arrangement, that is, the socket 100', inserted in a cutout 401 in a panel 400. The frame 180' surrounding the housing 110' as well as a screw 170 are dispensed with here. The stop edge 116' of the mounting flange 111' sits on the panel surface 402. From the rear side of the panel 400, the counter-plate 700' is screwed to the outside 127' of the housing base 125' by means of the screws 703'. In this way, the socket 100' is securely fixed in the panel cutout 401. If the support bar 200 is not inserted when not required, the cover plate 160' conceals the front side 154' of the screw-on plate 150' having the unoccupied through-hole 151' and countersink 152'. In this type of mounting, the cover plate 160' is therefore especially useful for the optical effect. With regard to the engagement of the support bar 200 in the socket 100', reference is made to FIG. 2.3.

Figure 3:
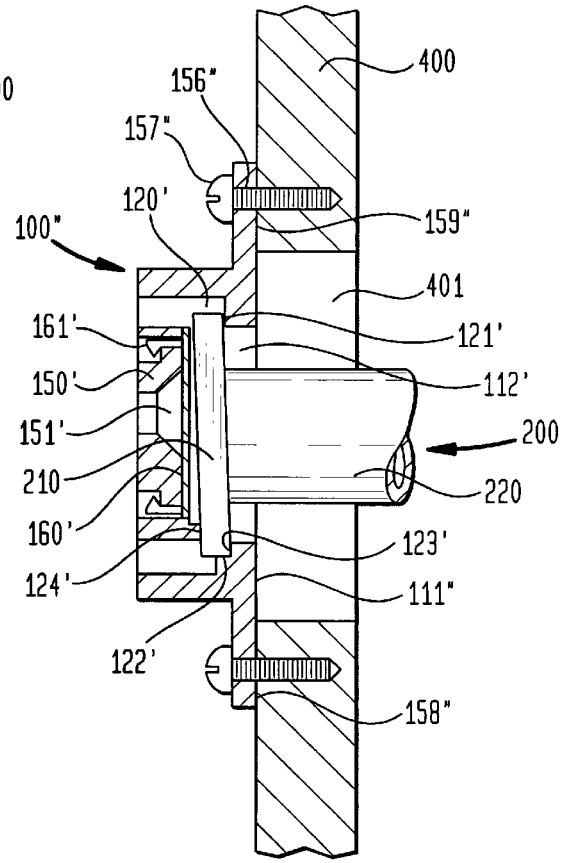
FIG. 3 shows a partial section of the socket put onto the rear of a panel (rear mounting on a wall facing)

A third embodiment of the supporting-bar arrangement can be seen from FIG. 3. The inner constructional design of the socket 100" (previously 100') is unchanged relative to FIGS. 2.0 to 2.4. With regard to the reference numerals entered in the figure but not mentioned below, reference is made to the explanations given for the aforesaid figures. The support bar 200 having the slip-in plate 210 and the tubular piece 220 is likewise unchanged. However, the mounting flange 111" (previously 111, 111') has been enlarged, in which case the stop edge 116' pointing in the direction of the screw-on plate 150' and located at the rear of the mounting flange is now no longer used in order to support the socket 100" at the marginal zones relative to the panel cutout 401—in the inserted type of mounting.

The front of the enlarged mounting flange 111" is now used to support the socket 100" at the marginal zones of a panel cutout 401, although the socket 100" is put onto the rear of the panel 400. The support bar 200 projects from the room through the panel cutout 401, and the slip-in plate 210 can be latched and unlatched inside the socket 100", virtually behind the panel 400, in the manner described above. It therefore goes without saying that the panel cutout 401 must have at least approximately the size of the slip-in plate 210, and the mounting flange 111" must project at least partly beyond the panel cutout 401.

There are various ways of fastening the mounting flange 111" to the rear side of the panel 400, such as screwing, adhesive bonding in place or locking. In this example, through-holes 156", through which screws 157" engage in the panel 400 from the rear side, are provided at the mounting flange 111". To improve the seating of the mounting flange 111" on the rear marginal zones relative to the panel cutout 401, a recess 158" is provided on the outer periphery of the mounting flange 111" [sic], as a result of which a mating edge 159" is obtained in which the margin of the panel cutout 401 sits in a positive-locking manner.

Figure 4:
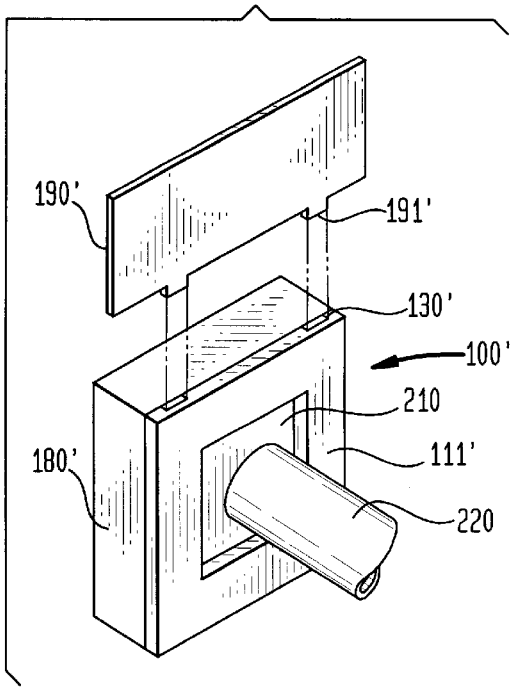
FIG. 4 shows the socket according to FIGS. 1.0 or 2.0 with frame, inserted support bar and juxtaposed information plate.
Figure 2A:
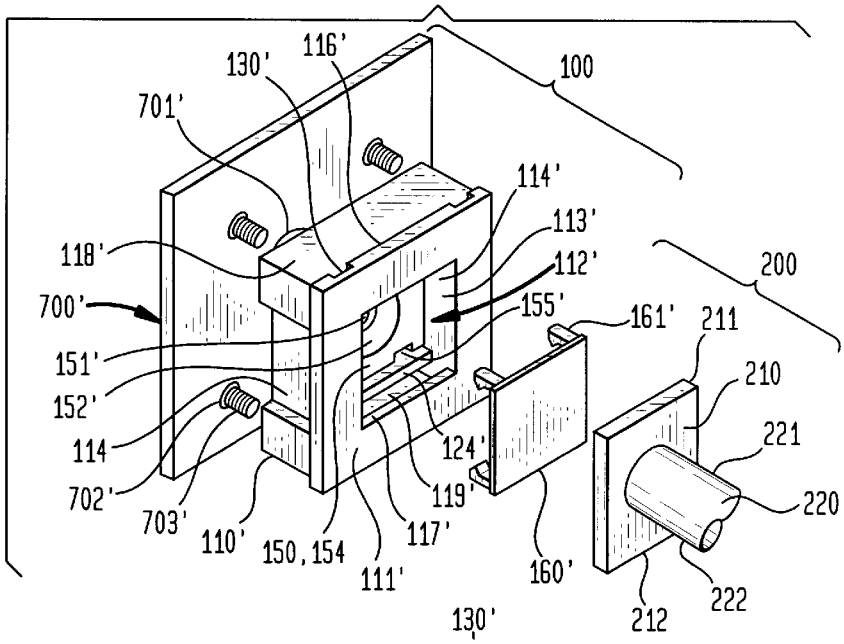
FIG. 2.0 shows a perspective view of the socket with fixed screw-on plate, counter-plate and juxtaposed support bar.
Figure 2B:
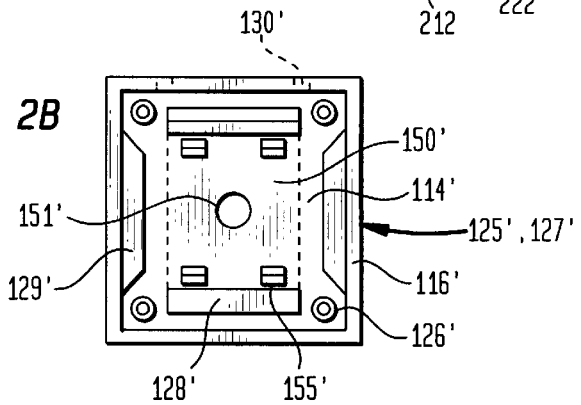
Figure 2C:
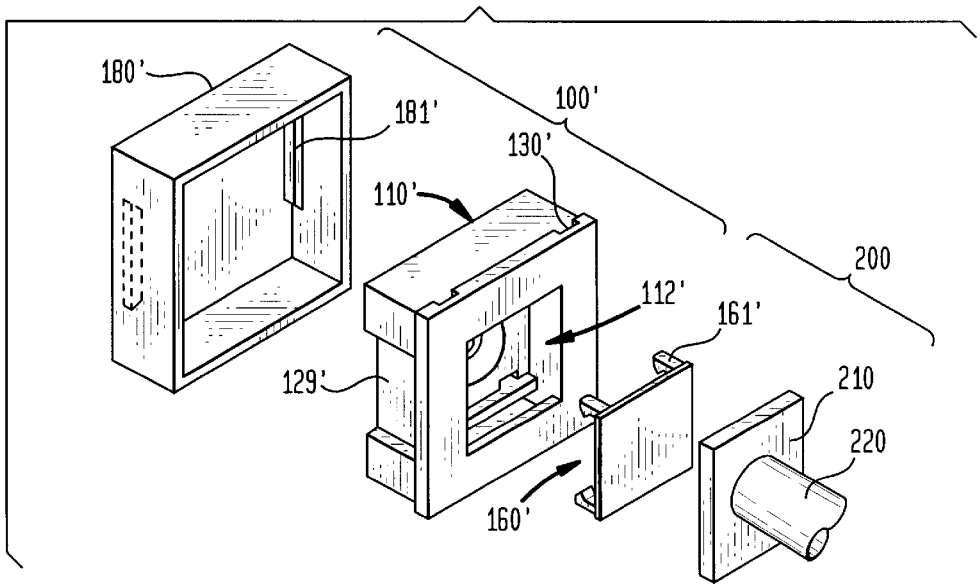
Figure 2D:
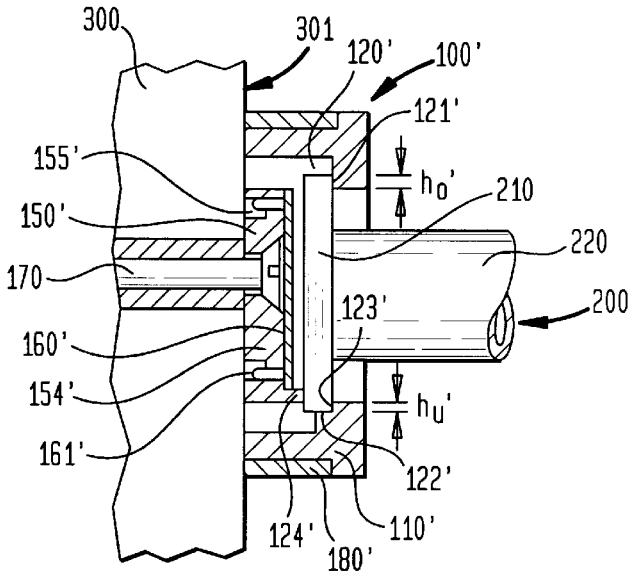
Figure 2E:
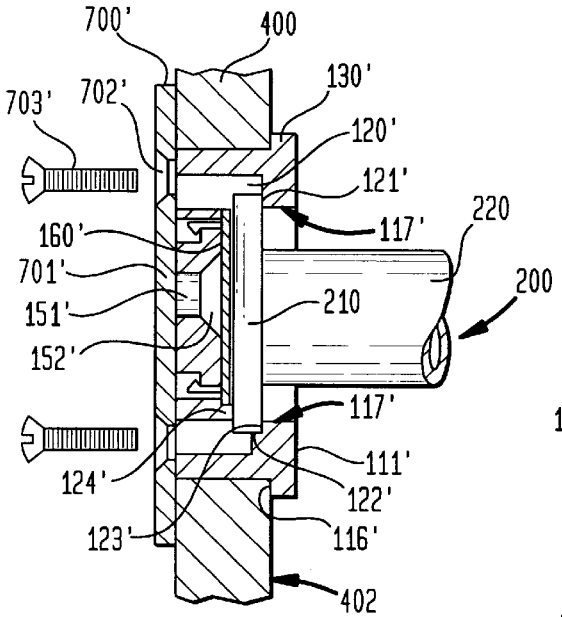

According to FIG. 4, an information plate 190' can be put onto the socket 100' if necessary—with the exception of the type of mounting according to FIG. 3—the tabs 191' of the information plate 190' being pressed into the vertical grooves 130' of the socket 100'. The vertical grooves 130' provided on the rear side of the mounting flange 111' and laterally open per se are bounded at the rear either by the frame 180' pushed onto the housing 110' (see FIG. 4) or by the panel surface 402 (see FIG. 2.4), so that the information plate 190' is held in both cases. The information plate 190' can easily be removed and can be provided with price, company, brand, size or other details.

Figure 5:
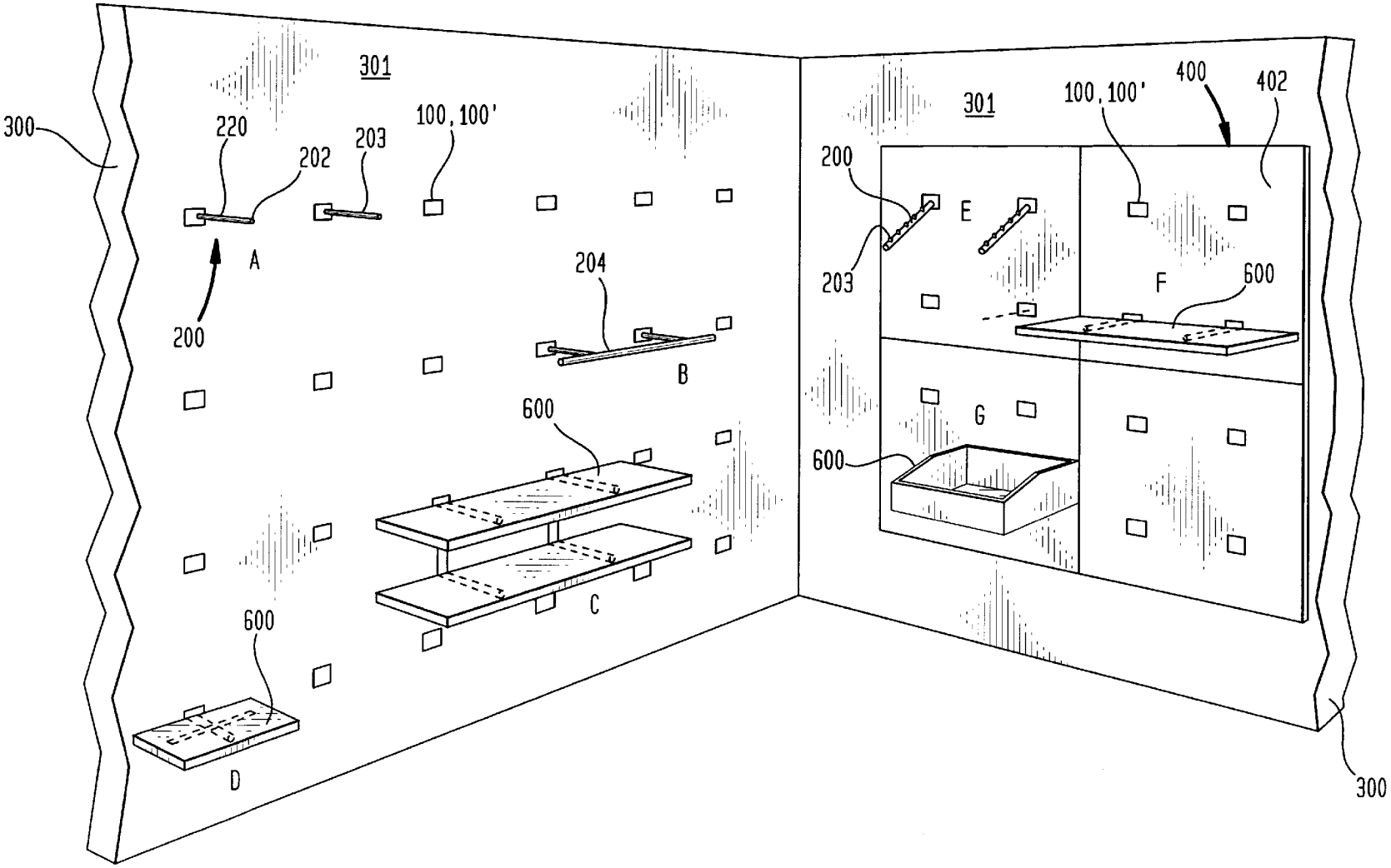
FIG. 5 shows possible configurations on a rear wall or on a panel.

Those uses of the supporting-bar arrangement where the sockets 100, 100', 100" are supported by a rear wall are shown in FIG. 5. A plurality of rows of sockets 100, 100', 100" spaced apart relative to one another are arranged in such a way that they are put onto the wall surface 301, inserted in a panel 400 or provided on the rear of a panel, which sockets 100, 100', 100" can then be equipped in different ways. It is also possible to put the sockets 100, 100', 100" onto a panel surface 402 or to insert them directly into a solid wall 300.

Variant A: shows individual support bars 200 projecting horizontally into the salesroom or display area and having a boundary lug 203 arranged at the top on the bar end 202;

Variant B: shows two adjacent support bars 200 which are connected to one another by a cross bar 204; this combination is inserted or removed as a unit;

Variant C: shows a goods support 600—here a shelf—put onto a plurality of adjacent support bars 200, and Variant D: shows the arrangement of a shelf as goods support 600 on an individual support bar; provision must be made here by means of adequate locking for the shelf to be held horizontally.

One or more panels 400—here four—are attached to the wall surface 301. A plurality of sockets 100, 100', 100" spaced apart relative to one another are inserted into the panels 400 or are put on at the rear, which sockets 100, 100', 100" can at the same time serve to fix the respective panel 400 to the wall surface 301.

Variant E: shows individual support bars 200 projecting in a tilted manner into the salesroom or display area and having a multiplicity of boundary lugs 203 arranged at the top on the tubular-piece top edge 221;

Variant F: shows an arrangement according to variant C, and

Variant G: shows the arrangement of a box-shaped goods support 600 open at the top.

Not only walls 300 or panels 400 are suitable as supports for the sockets 100, 100', 100". The sockets 100, 100', 100" can also be put onto strip-shaped, beam- or rail-like shelf components, e.g. a sectional rail or an adequately load-bearing sheet-metal strip. Special design effects and efficient utilization of the space can be achieved if one or more sockets 100, 100', 100" are inserted into a section, preferably a hollow section. This hollow section could be provided as a vertical, sloping, horizontal or curved strut inside a shop fitting. If the strut is accessible from several sides and if it has an appropriately large interior space, it is possible to insert sockets 100, 100', 100" from several sides, preferably from two opposite sides, into the section. The type 100 and 100' sockets are preferred for this use.

The following possible modifications to the supporting-bar arrangement described hitherto may also be expressly mentioned:

apertures 115 would not need to be provided on both sides in the two wall webs 114; instead of an aperture 115, a groove could also be made in one wall web 114, into which groove the screw-on plate 150 could be inserted;

the stop edge 116, 116' and thus also the frame 180, 180' could be completely dispensed with if the person skilled in the art would use other means of fixing the housing 110, 110' in a wall 300 or a panel 400—inserted type of mounting; the housing 110, 110' could be conical or could be fixed laterally by screws in the panel cutout 401;

the screw-on plate 150 is not provided as a loose screw-on plate 150 but is designed as a tightly fitting transverse plate;

a screw-on plate 150, 150' is completely dispensed with and the screwed connection of the socket 100, 100' to the rear wall 300 supporting the latter is effected by screws being passed through the wall webs 114, 114' or through the transverse webs 118, 119; 118', 119';

as an alternative to the screwed connection, the undetachable connection between rear wall 300 or panel 400 and socket 100, 100', for example by adhesive bonding or cementing, would also be suitable;

the housing 110, 110', the mounting flange 111, 111', 111", the insertion opening 112, 112' and the slip-in plate 210 need not be of rectangular contour; different geometric forms right up to round shapes are also conceivable here;

the tubular piece 220 could be round or polygonal in cross-section or be made of solid material, and finally, it would be possible to provide the undercuts 120, 122; 120', 122' not at the top and bottom but on the right and left in the wall webs 114, 114'. The slip-in plate 210 would have to be adapted in this case, and it would have to be inserted into the housing 110, 110' by lateral tilting. In this variant, however, there is a slightly increased risk of the support bar 200 unlatching inadvertently from the socket 100, 110' [sic] if the support bar 200 is manipulated in the horizontal plane.

The supporting-bar arrangement according to the invention permits a variable configuration of wall areas, shelf structures and other shop fittings created for the display of goods. The support bars for the direct hanging of goods or fitted with goods supports can be inserted into the sockets provided or unlatched from the latter in no time at all. Due to the constructional design, laborious adjustment of the individual sockets within a mulitplicity of sockets is dispensed with. When properly mounted and produced, the inserted support bars are exactly oriented by themselves and therefore also convey a solid appearance on the display wall, within the shelf or on the relevant fitting detail. There is no risk whatsoever of unintentional unlatching from the sockets when the public behave normally and handle goods normally at the goods supports or support bars.

I claim:

1. A goods support bar assembly, comprising:

a socket, including:

a housing having an interior;

a housing base located on a rear side of said housing and including a through-hole surrounded by a countersink, a plurality of through-slots, and a raised stop edge located on a lower edge of said housing base;

a window-like insertion opening;

a mounting flange located on a front side of said housing, and completely surrounding a perimeter of said insertion opening, so as to frame said insertion opening;

two wall webs positioned on a rear side of said mounting flange, said wall webs extending outside said insertion opening;

two transverse webs positioned on said rear side of said mounting flange and extending between said wall webs;

an upper undercut positioned in said interior of said housing and forming an upper buffer edge; and a lower undercut positioned in said interior of said housing and forming a lower buffer edge;

a cover plate including a plurality of hook lugs on a rear side thereof, said cover plate sized and shaped so as to pass through said insertion opening, said hook lugs engaging in said through-slots; and a support bar, including a tubular piece and a slip-in plate attached to an end of said tubular piece, said slip-in plate being sized and shaped so as to pass through said insertion opening when said slip-in plate is tilted relative to said insertion opening, said slip-in plate being held in said interior of said housing by said upper buffer edge and said lower buffer edge, said slip-in plate being removably but non-slidably received in said housing.

2. A goods support bar assembly according to claim 1, further comprising a frame surrounding said housing such that said frame abuts said rear side of said mounting flange and encloses said wall webs and said transverse webs.

3. A goods support bar assembly according to claim 2, wherein said socket is mounted on a wall surface, said frame abutting said wall surface.

4. A goods support bar assembly according to claim 1, wherein said upper buffer edge is located further in said interior of said housing than said lower buffer edge.

5. A goods support bar assembly according to claim 1, further comprising:

a plurality of tapped holes extending through said housing base;

a counter-plate sized and shaped at least as large as said mounting flange, said counter-plate including a center hole corresponding to said through-hole and a plurality of corner holes corresponding to said tapped holes; and a plurality of screws corresponding to said corner holes, said screws attaching said counter-plate to said housing base.

6. A goods support bar assembly according to claim 5, wherein said socket is inserted into a cutout in a panel mounted in front of a wall;

said mounting flange includes an encircling stop edge on said rear side thereof, said stop edge abutting an outer surface of said panel, thereby limiting the insertion depth of said socket into said panel; and said counter-plate is positioned on a rear side of said panel, behind said cutout.

7. A goods support bar assembly according to claim 5, wherein said upper buffer edge is located further in said interior of said housing than said lower buffer edge.

8. A goods support bar assembly according to claim 1, wherein said mounting flange extends away from said insertion opening; and said socket is mounted on a rear side of a cutout in a panel mounted in front of a wall, such that said mounting flange surrounds said cutout, and such that said slip-in plate passes through said cutout before engaging in said socket.

9. A goods support bar assembly according to claim 8, further comprising:

a plurality of through-holes in said mounting flange;

a plurality of screws corresponding to said through-holes to attach said socket to said panel; and a recess extending completely around an outer periphery of said mounting flange to create a mating edge which engages said cutout in a positive-locking manner.

10. A goods support bar assembly according to claim 8, wherein said upper buffer edge is located further in said interior of said housing than said lower buffer edge.

11. A goods support bar assembly according to claim 1, further comprising:

at least one groove in a top side of said mounting flange; and an information plate, including at least one tab complementary to said at least one groove, whereby said information plate is detachably connected to said socket.

12. A goods support bar assembly, comprising:

a socket, including:

a housing having an interior;

a window-like insertion opening;

a mounting flange located on a front side of said housing, and completely surrounding a perimeter of said insertion opening, so as to frame said insertion opening;

two wall webs positioned on a rear side of said mounting flange, said wall webs extending outside said insertion opening, each wall web including a slot-like aperture;

two transverse webs positioned on said rear side of said mounting flange and extending between said wall webs;

an upper undercut positioned in said interior of said housing and forming an upper buffer edge; and a lower undercut positioned in said interior of said housing and forming a lower buffer edge;

a screw-on plate sized and shaped to fit through said slot-like aperture, said screw-on plate including an outwardly facing mounting edge and a through-hole having a countersink;

a cover plate positioned on said mounting edge;

a screw inserted into said through-hole; and a support bar, including a tubular piece and a slip-in plate attached to an end of said tubular piece, said slip-in plate being sized and shaped so as to pass through said insertion opening when said slip-in plate is tilted relative to said insertion opening, said slip-in plate being held in said interior of said housing by said upper buffer edge and said lower buffer edge, said slip-in plate being removably but non-slidably received in said housing.

13. A goods support bar assembly according to claim 12, wherein said screw secures said housing to a mounting surface and includes a head having a blind hole; and said cover plate is sized and shaped so as to pass through said insertion opening and includes a slip-in lug complementary to said blind hole, such that said cover plate attaches to said screw-on plate.

14. A goods support bar assembly according to claim 12, wherein said socket is inserted into a cutout in a panel mounted in front of a wall; and said mounting flange includes an encircling stop edge on said rear side thereof, said stop edge abutting an outer surface of said panel, thereby limiting the insertion depth of said socket into said panel.

15. A goods support bar assembly according to claim 12, further comprising a frame surrounding said housing such that said frame abuts said rear side of said mounting flange and encloses said wall webs and said transverse webs.

16. A goods support bar assembly according to claim 15, wherein said socket is mounted on a wall surface, said frame abutting said wall surface.

* * * * *